US011391129B2

(12) United States Patent
Madasu et al.

(10) Patent No.: US 11,391,129 B2
(45) Date of Patent: Jul. 19, 2022

(54) WELLBORE GAS LIFT OPTIMIZATION

(71) Applicant: Landmark Graphics Corporation, Houston, TX (US)

(72) Inventors: Srinath Madasu, Houston, TX (US); Terry Wong, Spring, TX (US); Keshava Prasad Rangarajan, Sugar Land, TX (US); Steven Ward, Austin, TX (US); ZhiXiang Jiang, Beijing (CN)

(73) Assignee: Landmark Graphics Corporation, Houston, TX (US)

( * ) Notice: Subject to any disclaimer, the term of this patent is extended or adjusted under 35 U.S.C. 154(b) by 159 days.

(21) Appl. No.: 16/474,185

(22) PCT Filed: Aug. 9, 2018

(86) PCT No.: PCT/US2018/045949
§ 371 (c)(1),
(2) Date: Jun. 27, 2019

(87) PCT Pub. No.: WO2020/032949
PCT Pub. Date: Feb. 13, 2020

(65) Prior Publication Data
US 2021/0404302 A1 Dec. 30, 2021

(51) Int. Cl.
*E21B 43/12* (2006.01)
*E21B 49/08* (2006.01)

(52) U.S. Cl.
CPC ..... *E21B 43/122* (2013.01); *E21B 49/087* (2013.01); *E21B 2200/20* (2020.05); *E21B 2200/22* (2020.05)

(58) Field of Classification Search
CPC ..... E21B 33/00; E21B 43/122; E21B 43/13; E21B 2200/20
See application file for complete search history.

(56) References Cited

U.S. PATENT DOCUMENTS 7,577,527 B2 * 8/2009 Vega Velasquez ..... E21B 49/00 702/6
9,157,308 B2 10/2015 Balogun et al.
(Continued)

OTHER PUBLICATIONS

Berkenkamp, et al., "Bayesian Optimization with Safety Constraints: Safe and Automatic Parameter Tuning in Robotics", Learning & Adaptive Systems Group, Department of Computer Science, Robotics, arXiv:1602.04450v1 [cs.RO], Feb. 14, 2016, 9 pages.
(Continued)

*Primary Examiner* — Kristyn A Hall
(74) *Attorney, Agent, or Firm* — Kilpatrick Townsend & Stockton LLP

(57) ABSTRACT

A system and method for controlling a gas supply to provide gas lift for a production wellbore makes use of Bayesian optimization. A computing device controls a gas supply to inject gas into one or more wellbores. The computing device receives reservoir data associated with a subterranean reservoir to be penetrated by the wellbores and can simulate production using the reservoir data and using a physics-based or machine learning or hybrid physics-based machine learning model for the subterranean reservoir. The production simulation can provide production data. A Bayesian optimization of an objective function of the production data subject to any gas injection constraints can be performed to produce gas lift parameters. The gas lift parameters can be applied to the gas supply to control the injection of gas into the wellbore or wellbores.

20 Claims, 5 Drawing Sheets

(56) References Cited

U.S. PATENT DOCUMENTS

| | | | | |
|---|---|---|---|---|
| 9,280,517 | B2 | 3/2016 | Liu et al. | |
| 2012/0095603 | A1* | 4/2012 | Rashid | E21B 43/122 700/282 |
| 2014/0039793 | A1 | 2/2014 | Querales et al. | |
| 2015/0169798 | A1 | 6/2015 | Fleming et al. | |
| 2016/0053593 | A1 | 2/2016 | Romer et al. | |

OTHER PUBLICATIONS

Krishnamoorthy, et al., "Real-Time Optimization under Uncertainty Applied to a Gas Lifted Well Network", Processes, vol. 4, No. 52, available online at https://pdfs.semanticscholar.org/247/01bf6fd9045365dc6946b83851a9ae6108d3.pdf, Dec. 15, 2016, 32 pages.

PCT/US2018/045949, "International Search Report and Written Opinion", dated May 1, 2019, 9 pages.

Snoek, et al., "Scalable Bayesian Optimization Using Deep Neural Networks", Harvard University, School of Engineering and Applied Sciences, arXiv:1502.05700v2 [stat.ML], Jul. 13, 2015, 13 pages.

* cited by examiner

WELLBORE GAS LIFT OPTIMIZATION

TECHNICAL FIELD

The present disclosure relates generally to using artificial gas lift to aid production in well systems. More specifically, but not by way of limitation, this disclosure relates to real-time optimized control of gas lift parameters during production from a wellbore.

BACKGROUND

A well can include a wellbore drilled through a subterranean formation. The subterranean formation can include a rock matrix permeated by the oil that is to be extracted. The oil distributed through the rock matrix can be referred to as a reservoir. Reservoirs are often modeled with standard statistical techniques in order to make projections or determine parameter values that can be used in drilling or production to maximize the yield. As one example, partial differential equations referred to as the "black-oil" equations can be used to model a reservoir based on production ratios and other production data.

One method of augmenting oil production from a reservoir is to use artificial gas lift. Artificial gas lift involves injecting gas into the production string, or tubing, to decrease the density of the fluid, thereby decreasing the hydrostatic head to allow the reservoir pressure to act more favorably on the oil being lifted to the surface. This gas injection can be accomplished by pumping or forcing gas down the annulus between the production tubing and the casing of the well and then into the production tubing. Gas bubbles mix with the reservoir fluids, thus reducing the overall density of the mixture and improving lift.

DETAILED DESCRIPTION

Certain aspects and features relate to a system that improves, and makes more efficient, the projection of optimized values for controllable artificial gas lift parameters such as gas lift injection rate and choke size. The controllable parameters can be computed, taking into account reservoir data and a physics-based or machine learning or hybrid physics-based machine learning reservoir model. The parameters can be utilized for real-time control and automation in a gas lift system to maximize production efficiency.

The system according to some examples described herein can provide gas lift optimization using a reservoir production simulation to formulate an objective function based on the amount of oil produced and the rate of gas injected to provide the artificial lift. Optimized gas lift parameters can be projected using Bayesian optimization (BO). The objective function can be based on simulated production data generated from the physics-based or machine learning or hybrid physics-based machine learning reservoir model. The reservoir model can be used to generate the necessary data required for the optimization. The examples couple the reservoir model with gas lift parameters and input minimization using Bayesian optimization. The Bayesian optimization can provide the gas lift parameters for in-the-field optimization with multiple wells in a cluster of wells drawing from the same reservoir.

In some examples, a system includes a gas supply arrangement to inject gas into one or more wellbores and a computing device in communication with the gas supply arrangement. The computing device includes a memory device with instructions that are executable by the computing device to cause the computing device to receive reservoir data associated with a subterranean reservoir to be penetrated by the wellbores and simulate production using the reservoir data and using a physics-based or machine learning or hybrid physics-based machine learning model for the subterranean reservoir. The production simulation provides production data. A Bayesian optimization of an objective function of the production data subject to any gas injection constraints is performed to produce gas lift parameters in response to convergence criteria being met. The gas lift parameters are applied to the gas supply to control the injection of gas into the wellbore or wellbores.

Figure 1:
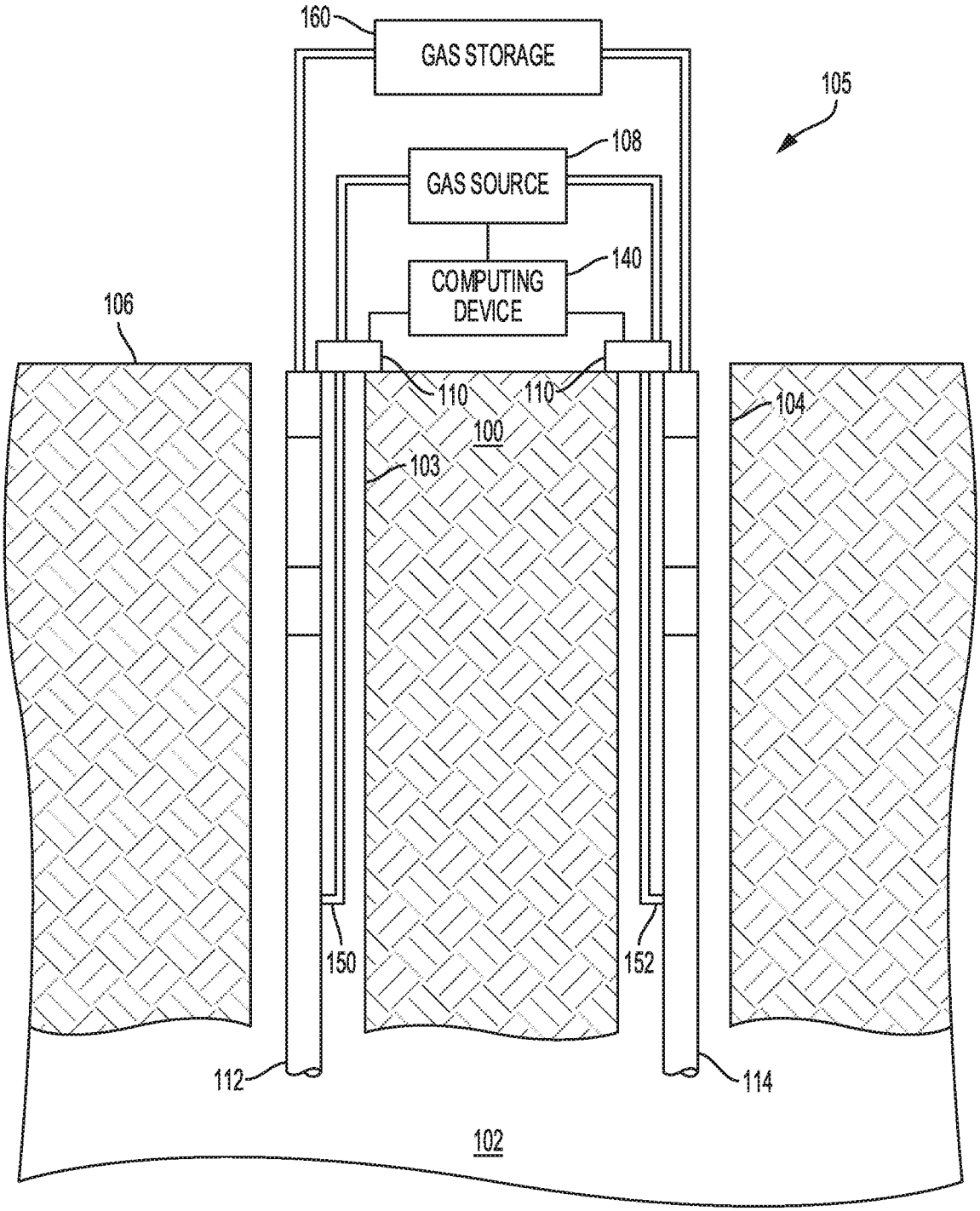
FIG. 1 is a cross-sectional side view of an example reservoir with well cluster that includes a system for creating artificial gas lift in production wells according to some aspects.

FIG. 1 is a cross-sectional view of an example of subterranean formation 100 with a reservoir 102 that is subject to production through a cluster of wells including wells defined by clustered wellbores 103 and 104. System 105 includes computing device 140 disposed at the surface 106 of subterranean formation 100, as well as gas source 108, which in this example is connected to metering and flow control devices 110. The gas source may include a compressor (not shown). The gas source 108 and a metering and flow control device 110 work together supply gas to a well and can be referred to herein as a "gas supply system." "gas supply arrangement," or a "gas supply." The metering and flow control devices 110 may be connected to or be part of a manifold system (not shown) with multiple gas outlets. Production tubing string 112 is disposed in wellbore 103. Production tubing string 114 is disposed in wellbore 104. It should be noted that while wellbores 103 and 104 are shown as vertical wellbores, either or both wellbores can additionally or alternatively have a substantially horizontal section.

During operation of system 105 of FIG. 1, gas flows downhole from the gas supply and enters production tubing 112 through injection port 150. Gas also enters production tubing 114 through injection port 152. Gas returns to the surface 106 and can be captured in gas storage device 160 to be held for other uses or recycled. Gas storage device 160 can include a storage tank.

Still referring to FIG. 1, computing device 140 is connected to gas source 108 and metering and flow control devices 110 to control the gas supply for wellbores 103 and 104. The computing device can also receive and store reservoir data to be used in production simulations. Reservoir data can be received through the production strings with sensors (not shown) that feed signals to computing device 140, from stored files generated from past reservoir monitoring, or even through user input. Data can include characteristics of the reservoir 102 such as viscosity, velocity, and fluid pressure as these quantities spatially vary. The data associated with the subterranean reservoir is used for reservoir modeling and production simulation in computing device 140 according to aspects described herein.

Figure 2:
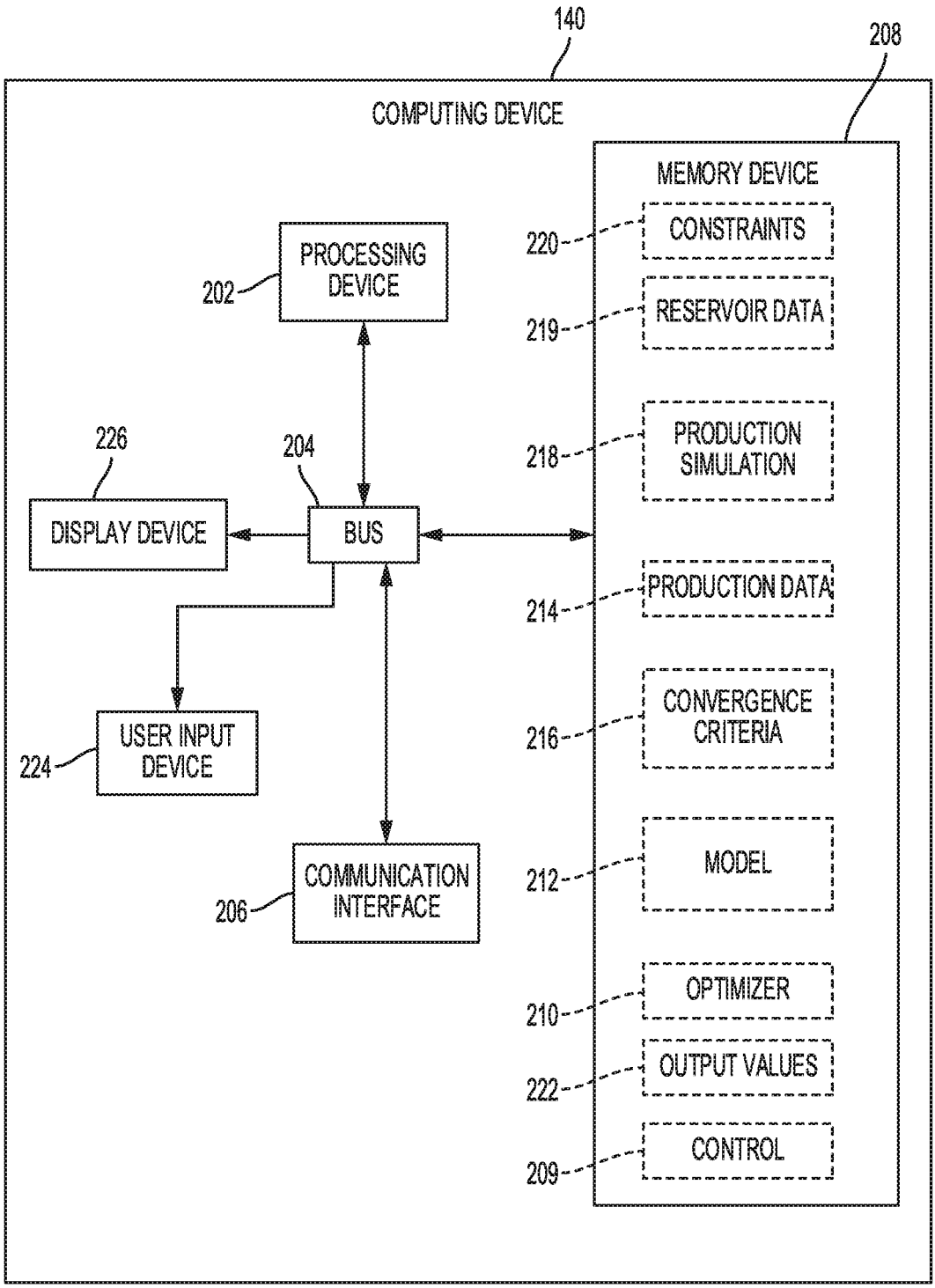
FIG. 2 is block diagram of a computing device for controlling gas lift parameters according to some aspects.

FIG. 2 depicts an example of a computing device 140. The computing device 140 includes a processing device 202, a bus 204, a communication interface 206, a memory device 208, a user input device 224, and a display device 226. In some examples, some or all of the components shown in FIG. 2 can be integrated into a single structure, such as a single housing. In other examples, some or all of the components shown in FIG. 2 can be distributed (e.g., in separate housings) and in communication with each other. The processing device 202 can execute one or more operations for optimizing gas lift. The processing device 202 can execute instructions stored in the memory device 208 to perform the operations. The processing device 202 can include one processing device or multiple processing devices. Non-limiting examples of the processing device 202 include a field-programmable gate array ("FPGA"), an application-specific integrated circuit ("ASIC"), a microprocessing device, etc.

The processing device 202 shown in FIG. 2 is communicatively coupled to the memory device 208 via the bus 204. The non-transitory memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 can include a non-transitory computer-readable medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

Still referring to the example of FIG. 2, the memory device 208 includes stored values for constraints 220 to be used in optimizing controllable gas lift parameters. The maximum gas lift capacity of the system is one example of a constraint. The memory device 208 includes computer program code instructions 209 for controlling the gas supply for the wells of a well cluster. The instructions for controlling the gas supply may include a proportional-integral-derivative (PID) controller. Memory device 208 in this example includes a physics-based or machine learning or hybrid physics-based machine learning model 212 of the reservoir 102. Reservoir data 219 is also stored in memory device 208 and can be used with the physics-based or machine learning or hybrid physics-based machine learning model 212 to run a production simulation. Production simulation program code instructions 218 are stored in memory device 208. The production simulation produces production data 214, which is also stored in memory device 208. The memory device 208 in this example includes an optimizer 210. The optimizer can be, for example, computer program code instructions to implement Bayesian optimization of an objective function of the production data to produce optimum values for controllable gas lift parameters. Results from the optimizer can be stored as controllable output values 222 in the memory device 208. Optimizer 210 can optimize the objective function subject to convergence criteria 216 to produce output values 222.

In some examples, the computing device 140 includes a communication interface 206. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11. Bluetooth, near-field communication (NFC) interfaces. RFID interfaces, or radio interfaces for accessing cellular telephone networks (e.g., transceiver/antenna for accessing a CDMA, GSM, UMTS, or other mobile communications network).

In some examples, the computing device 140 includes a user input device 224. The user input device 224 can represent one or more components used to input data. Examples of the user input device 224 can include a keyboard, mouse, touchpad, button, or touch-screen display, etc. In some examples, the computing device 140 includes a display device 226. Examples of the display device 226 can include a liquid-crystal display (LCD), a television, a computer monitor, a touch-screen display, etc. In some examples, the user input device 224 and the display device 226 can be a single device, such as a touch-screen display.

Figure 3:
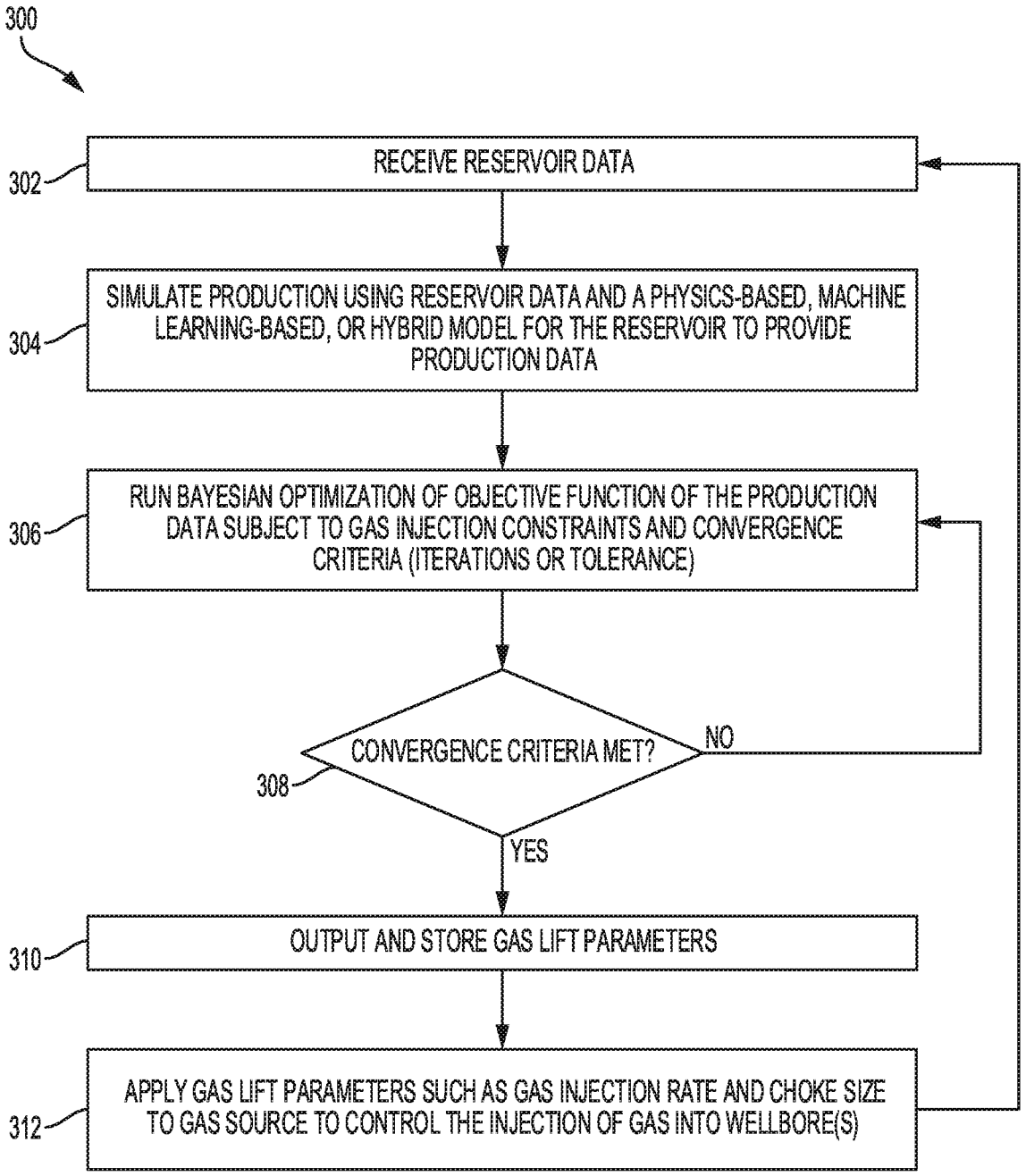
FIG. 3 is a flowchart illustrating a process for controlling a gas lift system according some aspects.

FIG. 3 is a flowchart illustrating a process 300 for controlling a gas lift system according some aspects. At block 302, reservoir data 219 is received by computing device 140. At block 304, processing device 202 simulates production using the reservoir data 219 and the physics-based or machine learning or hybrid physics-based machine learning model 212 with the reservoir data to provide production data 214. At block 306, processing device 202 runs a Bayesian optimization of an objective function of the production data 214 subject to gas injection constraints 220 and convergence criteria 216. The processing device in this example runs the Bayesian optimization using optimizer 210. As examples, the convergence criteria can include a maximum number of iterations of the optimizer, convergence within a specified tolerance of maximum production rate, convergence within a specified range of a minimum friction value for the production tubing, or a combination of any or all of these. If the convergence criteria are met at block 308, the processing device outputs and stores gas lift parameters at block 310 as output values 222. If convergence criteria are not met at block 308, Bayesian optimization iterations continue at block 306. The gas lift parameters are applied to the gas source at block 312 to control the injection of gas into the wellbore. In some examples, the gas lift parameters include gas injection rate, choke size, or both.

Process 300 of FIG. 3 uses Bayesian optimization to model production with optimal parameters for artificial gas lift. Production is a function gas injection rate, which can be constant or function of time. Optimum gas injection rate is herein considered to be the rate needed to maximize production and minimize the friction in the production tubing. The optimal choke size for purposes of the examples described herein is the size needed to avoid back pressure at a gas storage point, for example, gas storage device 160 in FIG. 1.

The example process shown in FIG. 3 can be used to project the gas lift parameters that maximize efficiency in the sense that the projected parameters are the values that should maximize production while minimizing input. Since oil produced determines revenue and gas input is a variable cost, these values can to at least some extent be treated as the values that will maximize profit. As an example, profit can be computed by:

$$Q^{*}\text{price}^{*}(\text{fraction of revenue retained})-(\text{gas rate})^{*}(\text{gas price})$$

The fraction of revenue retained from a particular well cluster would be the fraction of revenue left after paying leases and operating costs. Q is the oil production rate, which is a function of the fracture length, fracture width, and conductivity of the reservoir as modeled. These relationships provide the objective function that is used for Bayesian optimization as described herein. An objective function is sometimes also referred to as a "cost function."

Figure 4:
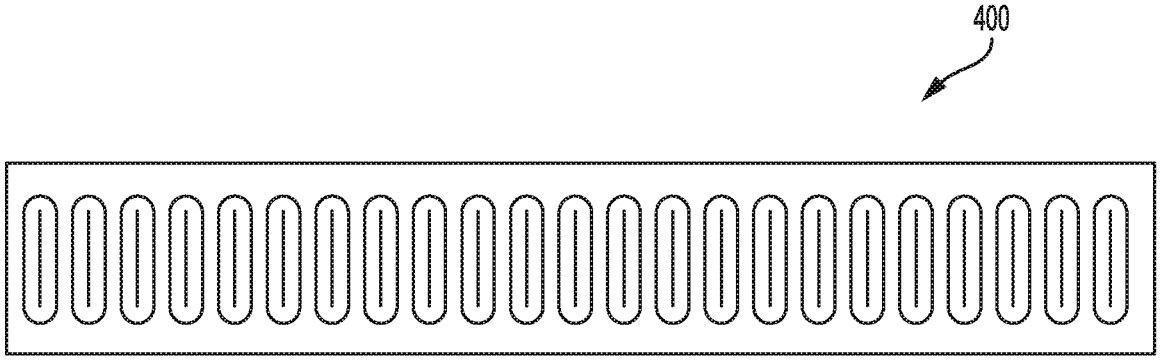
FIG. 4 is a graphical representation of a pressure contours along fractures of a reservoir as modeled according to some aspects.
Figure 5A:
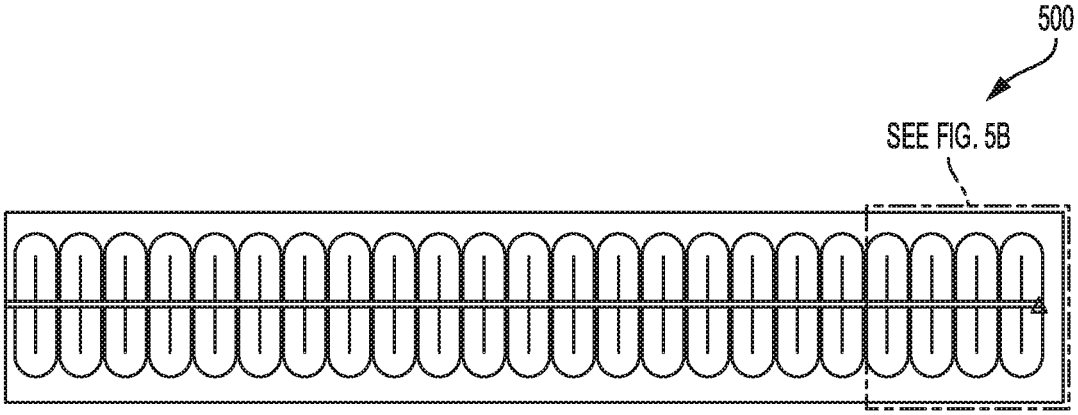
FIG. 5A and FIG. 5B are, respectively, a schematic representation of the pressure contours of FIG. 4 and a detailed graphical representation of a portion of that schematic representation.
Figure 5B:
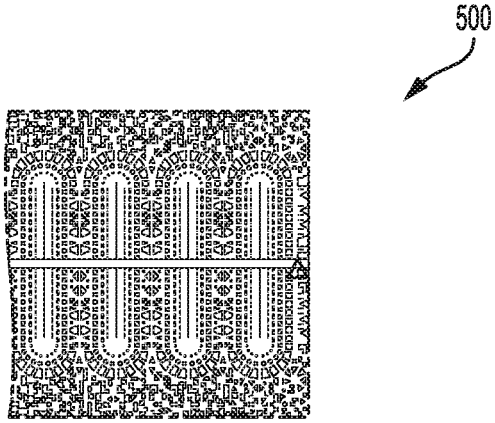

The example process described herein was used for a well with a reservoir model including 12 layers with permeability of 0.002 mD, porosity of 25%, initial water saturation of 0.2, initial pressure of 3500 psia, 23 hydraulic fractures with half-length of 500 ft, an aperture of 0.1 in, conductivity at a perf of 3 mD, and porosity of 30%. FIG. 4 is a graphical representation 400 of the pressure contours along the 23 fractures as produced with Nexus® reservoir simulation software. FIG. 5A is a schematic representation 500 of the fractures and FIG. 5B is a close-up view of a portion of FIG. 5A so that an unstructured, superimposed grid is visible. The projected optimal gas injection rate in this case using the example process described herein was 517.55 Mscf/day. The Bayesian optimization projected the optimal parameters with nine observations. The Bayesian optimization projected a maximum efficiency that would result in profit of $337.44 million at the optimal gas injection rate of 517.55 Mscf/day.

Figure 6:
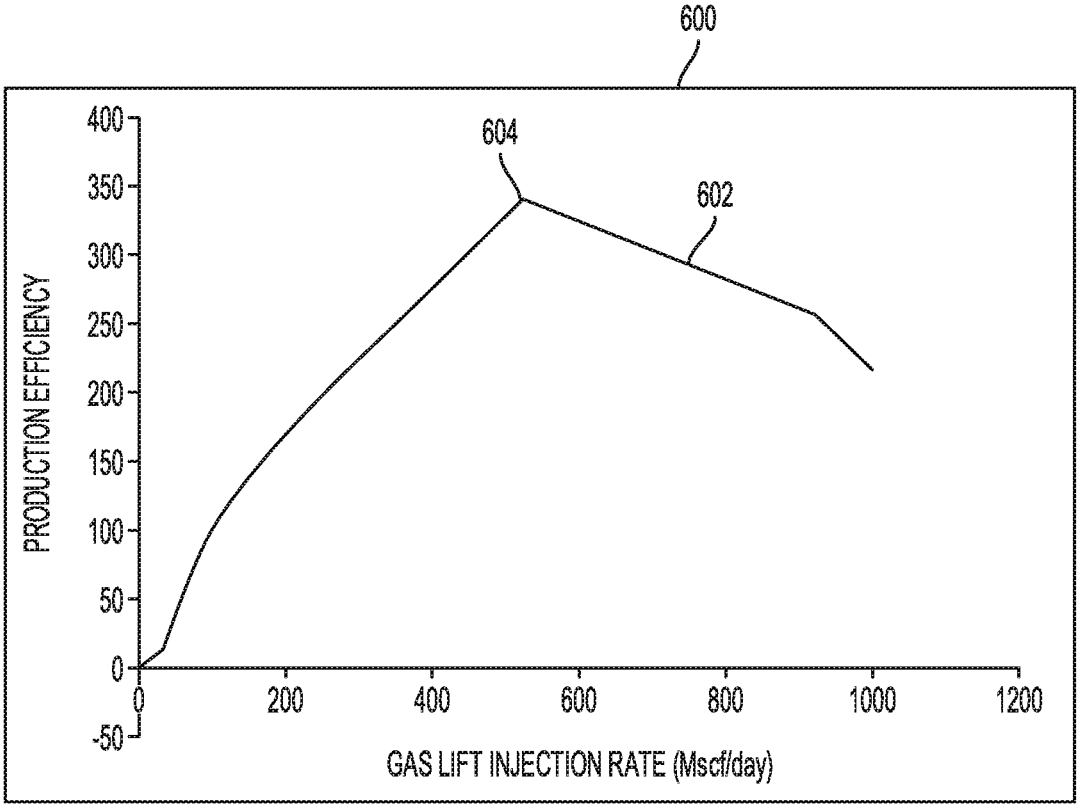
FIG. 6 is a graph of production efficiency as a function of gas lift injection rate for an example well and reservoir according to some aspects.

FIG. 6 shows a graph 600 the actual production rate as a function of gas injection rate for the reservoir modeled as described above. Efficiency is plotted on the y-axis and gas lift injection rate is plotted on the x-axis. Line 602 illustrates the actual gas-lift augmented production and point 604 is where maximum efficiency occurs. The projection made using the Bayesian optimization is very close to the actual best gas injection rate.

Unless specifically stated otherwise, it is appreciated that throughout this specification that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

As used below, any reference to a series of examples is to be understood as a reference to each of those examples disjunctively (e.g., "Examples 1-4" is to be understood as "Examples 1, 2, 3, or 4").

Example 1

A system includes a gas supply arrangement to inject gas into at least one wellbore in proximity to production tubing for the at least one wellbore and a computing device in communication with the gas supply arrangement. The computing device includes a non-transitory memory device including instructions that are executable by the computing device to cause the computing device to perform operations. The operations include receiving reservoir data associated with a subterranean reservoir to be penetrated by the at least one wellbore, simulating production using the reservoir data associated with the subterranean reservoir and using a physics-based model, a machine learning model, or a hybrid physics-based machine learning model for the subterranean reservoir to provide production data, performing a Bayesian optimization of an objective function of the production data subject to gas injection constraints and convergence criteria to produce gas lift parameters, and applying the gas lift parameters to the gas supply arrangement in response to the convergence criteria being met to control an injection of gas into the at least one wellbore.

Example 2

The system of example 1 wherein the at least one wellbore includes multiple clustered wellbores. The system further includes a production tubing string disposed in at least one of the plurality of clustered wellbores, an injection port connected to the production tubing string to inject gas into the production tubing string downhole, and a gas storage device connected to the production tubing string.

Example 3

The system of example(s) 1-2 wherein the gas lift parameters include gas injection rate and choke size.

Example 4

The system of example(s) 1-3 wherein the gas injection rate is constant.

Example 5

The system of example(s) 1-4 wherein the gas injection rate is a function of time.

Example 6

The system of example(s) 1-5 wherein the convergence criteria include a maximum number of iterations.

Example 7

The system of example(s) 1-6 wherein the convergence criteria include convergence within a specified tolerance to a maximum production rate and a minimum friction value for the production tubing.

Example 8

A method includes receiving, by a processing device, reservoir data associated with a subterranean reservoir to be penetrated by at least one wellbore, simulating, by the processing device, production using the reservoir data associated with the subterranean reservoir and using a physics-based model, a machine learning model, or a hybrid physics-based machine learning model for the subterranean reservoir to provide production data, performing, by the processing device, a Bayesian optimization of an objective function of the production data subject to gas injection constraints and convergence criteria to produce gas lift parameters, and applying, by the processing device, the gas lift parameters to a gas supply arrangement in response to the convergence criteria being met to control an injection of gas into the at least one wellbore.

Example 9

The method of example 8 wherein the at least one wellbore includes multiple clustered wellbores. At least one of the wellbores includes a production tubing string. The method further includes injecting gas into the production tubing string downhole, and capturing gas at a gas storage device connected to the production tubing string.

Example 10

The method of example(s) 8-9 wherein the gas lift parameters include gas injection rate and choke size.

Example 11

The method of example(s) 8-10 wherein the gas injection rate is constant.

Example 12

The method of example(s) 8-11 wherein the gas injection rate is a function of time.

Example 13

The method of example(s) 8-12 wherein the convergence criteria include a maximum number of iterations.

Example 14

The method of example(s) 8-13 wherein the convergence criteria include convergence within a specified tolerance to a maximum production rate and a minimum friction value for production tubing.

Example 15

A non-transitory computer-readable medium includes instructions that are executable by a processing device for causing the processing device to perform a method. The method includes receiving reservoir data associated with a subterranean reservoir to be penetrated by a cluster of wellbores, simulating production using the reservoir data associated with the subterranean reservoir and using a physics-based model, a machine learning model, or a hybrid physics-based machine learning model for the subterranean reservoir to provide production data, performing a Bayesian optimization of an objective function of the production data subject to gas injection constraints and convergence criteria to produce gas lift parameters, and applying the gas lift parameters to a gas supply arrangement in response to the convergence criteria being met to control an injection of gas into at least one wellbore of the cluster of wellbores.

Example 16

The non-transitory computer-readable medium of example 15 wherein the gas lift parameters include gas injection rate and choke size.

Example 17

The non-transitory computer-readable medium of example(s) 15-16 wherein the gas injection rate is constant Example 18

The non-transitory computer-readable medium of example(s) 15-17 wherein the gas injection rate is a function of time.

Example 19

The non-transitory computer-readable medium of example(s) 15-18 further includes instructions that are executable by a processing device for causing the processing device to inject gas into a production tubing string downhole and capture gas at a gas storage device connected to the production tubing string.

Example 20

The non-transitory computer-readable medium of example(s) 15-19 wherein the convergence criteria includes at least one of a maximum number of iterations, or convergence within a specified tolerance to a maximum production rate and a minimum friction value for the production tubing.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a gas supply arrangement to inject gas into at least one wellbore in proximity to production tubing for the at least one wellbore; and a computing device in communication with the gas supply arrangement, the computing device including a non-transitory memory device comprising instructions that are executable by the computing device to cause the computing device to perform operations comprising:

receiving reservoir data associated with a subterranean reservoir to be penetrated by the at least one wellbore;

simulating production using the reservoir data associated with the subterranean reservoir and using a physics-based model, a machine learning model, or a hybrid physics-based machine learning model for the subterranean reservoir to provide production data;

performing a Bayesian optimization of an objective function of the production data subject to gas injection constraints and convergence criteria to produce gas lift parameters, the convergence criteria corresponding to a maximum number of iterations of an optimizer, to a convergence within a specified tolerance of maximum production rate, or to a convergence within a specified range of a minimum friction value; and applying the gas lift parameters to the gas supply arrangement in response to the convergence criteria being met to control an injection of gas into the at least one wellbore.

2. The system of claim 1 wherein the at least one wellbore comprises a plurality of clustered wellbores, the system further comprising:

a production tubing string disposed in at least one of the plurality of clustered wellbores;

an injection port connected to the production tubing string to inject gas into the production tubing string downhole; and a gas storage device connected to the production tubing string.

3. The system of claim 1 wherein the gas lift parameters comprise gas injection rate and choke size.

4. The system of claim 3 wherein the gas injection rate is constant.

5. The system of claim 3 wherein the gas injection rate is a function of time.

6. The system of claim 1 wherein the convergence criteria comprise a maximum number of iterations.

7. The system of claim 1 wherein the convergence criteria comprise convergence within a specified tolerance to a maximum production rate and a minimum friction value for the production tubing.

8. A method comprising:

receiving, by a processing device, reservoir data associated with a subterranean reservoir to be penetrated by at least one wellbore;

simulating, by the processing device, production using the reservoir data associated with the subterranean reservoir and using a physics-based model, a machine learning model, or a hybrid physics-based machine learning model for the subterranean reservoir to provide production data;

performing, by the processing device, a Bayesian optimization of an objective function of the production data subject to gas injection constraints and convergence criteria to produce gas lift parameters, the convergence criteria corresponding to a maximum number of iterations of an optimizer, to a convergence within a specified tolerance of maximum production rate, or to a convergence within a specified range of a minimum friction value; and applying, by the processing device, the gas lift parameters to a gas supply arrangement in response to the convergence criteria being met to control an injection of gas into the at least one wellbore.

9. The method of claim 8 wherein the at least one wellbore comprises a plurality of clustered wellbores, at least one of the plurality of clustered wellbores including a production tubing string, the method further comprising:

injecting gas into the production tubing string downhole; and capturing gas at a gas storage device connected to the production tubing string.

10. The method of claim 8 wherein the gas lift parameters comprise gas injection rate and choke size.

11. The method of claim 10 wherein the gas injection rate is constant.

12. The method of claim 10 wherein the gas injection rate is a function of time.

13. The method of claim 8 wherein the convergence criteria comprise a maximum number of iterations.

14. The method of claim 8 wherein the convergence criteria comprise convergence within a specified tolerance to a maximum production rate and a minimum friction value for production tubing.

15. A non-transitory computer-readable medium that includes instructions that are executable by a processing device for causing the processing device to perform a method comprising:

receiving reservoir data associated with a subterranean reservoir to be penetrated by a cluster of wellbores;

simulating production using the reservoir data associated with the subterranean reservoir and using a physics-based model, a machine learning model, or a hybrid physics-based machine learning model for the subterranean reservoir to provide production data;

performing a Bayesian optimization of an objective function of the production data subject to gas injection constraints and convergence criteria to produce gas lift parameters, the convergence criteria corresponding to a maximum number of iterations of an optimizer, to a convergence within a specified tolerance of maximum production rate, or to a convergence within a specified range of a minimum friction value; and applying the gas lift parameters to a gas supply arrangement in response to the convergence criteria being met to control an injection of gas into at least one wellbore of the cluster of wellbores.

16. The non-transitory computer-readable medium of claim 15 wherein the gas lift parameters comprise gas injection rate and choke size.

17. The non-transitory computer-readable medium of claim 16 wherein the gas injection rate is constant.

18. The non-transitory computer-readable medium of claim 16 wherein the gas injection rate is a function of time.

19. The non-transitory computer-readable medium of claim 15 further comprising instructions that are executable by a processing device for causing the processing device to:

inject gas into a production tubing string downhole; and capture gas at a gas storage device connected to the production tubing string.

20. The non-transitory computer-readable medium of claim 19 wherein the convergence criteria comprise at least one of a maximum number of iterations, or convergence within a specified tolerance to a maximum production rate and a minimum friction value for the production tubing.

* * * * *